US007122099B1

(12) United States Patent
Schumacher et al.

(10) Patent No.: US 7,122,099 B1
(45) Date of Patent: Oct. 17, 2006

(54) METHOD AND DEVICE FOR EVACUATING HOT RAW GASES FROM COKE OVENS

(75) Inventors: Ralf Schumacher, Hagen (DE); Hermann Toll, Essen (DE); Rainer Worberg, Bottrop (DE)

(73) Assignee: Uhde GmbH, Dortmund (DE)

( * ) Notice: Subject to any disclaimer, the term of this patent is extended or adjusted under 35 U.S.C. 154(b) by 761 days.

(21) Appl. No.: 10/111,290

(22) PCT Filed: Sep. 2, 2000

(86) PCT No.: PCT/EP00/08577

§ 371 (c)(1),
(2), (4) Date: Apr. 22, 2002

(87) PCT Pub. No.: WO01/30940

PCT Pub. Date: May 3, 2001

(30) Foreign Application Priority Data

Oct. 22, 1999 (DE) ..... 199 51 191

(51) Int. Cl.
*C10B 1/00* (2006.01)

(52) U.S. Cl. ..... 202/262; 202/263; 202/255; 202/226; 201/40

(58) Field of Classification Search ..... 202/262, 202/263, 255, 226; 201/40
See application file for complete search history.

(56) References Cited

U.S. PATENT DOCUMENTS

| | | | | |
|---|---|---|---|---|
| 1,524,098 A | | 1/1925 | Means | |
| 1,542,065 A | | 6/1925 | Koppers | |
| 3,243,360 A | * | 3/1966 | Wethly | 202/256 |
| 3,647,053 A | * | 3/1972 | Palumbo | 201/1 |
| 3,697,381 A | * | 10/1972 | Kemmelmueller | 201/40 |
| 4,235,624 A | | 11/1980 | Wagener et al. | |

FOREIGN PATENT DOCUMENTS

| | | |
|---|---|---|
| BE | 401924 | 5/1934 |
| DE | 339931 | 8/1921 |
| DE | 800571 | 11/1950 |
| DE | 27 33 785 | 2/1979 |
| FR | 565 785 | 2/1924 |
| GB | 376 606 | 11/1932 |
| GB | 403 206 | 12/1933 |

OTHER PUBLICATIONS

Partial translation of Fr 565785, translated Jul. 20, 2005.*
Translation of drawings of Fr 565785, translated Jul. 20, 2005.*

* cited by examiner

*Primary Examiner*—Glenn Caldarola
*Assistant Examiner*—Alexis Wachtel
(74) *Attorney, Agent, or Firm*—Collard & Roe, P.C.

(57) ABSTRACT

The invention relates to a method and a device for evacuating hot raw gases which occur in the oven chambers of a coke oven battery during coking. The oven gases are lead from the oven chambers into a hot gas collector. The pressure in the oven chambers is controlled by shut-off and throttling devices which are arranged in the hot gas streams between the raw gas outlet of the oven chambers and the hot gas collector. The positions of the devices are controlled according to the pressure that is measured in the allocated oven chamber. The gas of the hot gas collector is supplied to a steam boiler firing or a fission reactor.

7 Claims, 3 Drawing Sheets

METHOD AND DEVICE FOR EVACUATING HOT RAW GASES FROM COKE OVENS

CROSS REFERENCE TO RELATED APPLICATIONS

Figure 1B:
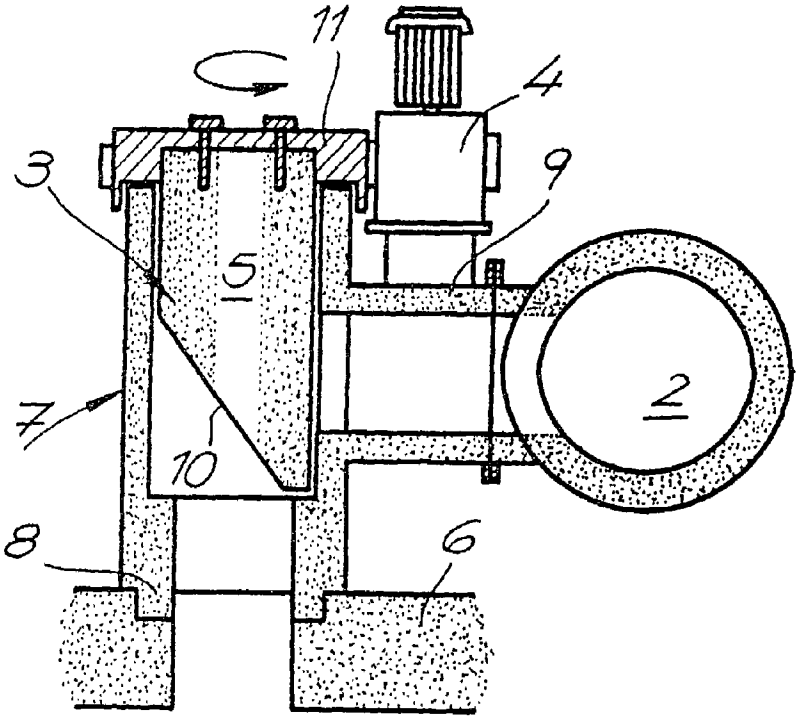

Applicants claim priority under 35 U.S.C. §119 of Germany Application No. 199 51 191.8 filed Oct. 22, 1999. Applicants also claim priority under 35 U.S.C. §120 of PCT/EP00/08577 filed Sep. 2, 2000. The international application under PCT article 21(2) was not published in English.

The invention relates to a method for evacuating hot raw gases developing in the coking process in the furnace chambers of a battery of coke ovens.

The technological change in the steel industry, in particular the increasing application of extrusion casting and thin-bed methods have led to a distinct reduction in the energy consumption in steel production plants. For coke oven gas, which was used in the past for thermal and annealing furnaces, it is necessary to find technical and economical applications such as, for example in the form of conversion into electric energy. Efforts undertaken until now to make the hot raw gases developing in the coking process available to some other application, with exploitation of its physical calorific content, have failed because of the problem of maintaining the pressure in the oven chambers of the battery of coke ovens.

The invention is based on the problem of providing a method, by which the hot raw gases produced during coking in the oven chambers can be readily supplied without further treatment and without lowering the raw gas temperature, to complete combustion or fission, notably without influencing in this way the coking process taking place in the oven chambers. In particular, the aim is to assure that a specified constant chamber pressure is always maintained in the oven chambers.

The object of the invention and of the solution to said problem is a method for evacuating hot raw gases developing in the coking process in the oven chambers of a coke oven battery, whereby

- the raw gases coming from the oven chambers are admitted into a hot gas collector;
- the pressure in the oven chambers is controlled by the shutoff and throttling devices, which are arranged in the streams of hot gas between the raw gas outlet of the oven chambers and the hot gas collector, and whose positions are controlled depending on the pressure measured in the associated oven chamber; and
- the gas coming from the hot gas collector is supplied to a steam boiler firing system or fission reactor.

According to the invention, the hot gas collector is maintained under a low vacuum that may correspond with up to about 100 mm WS (water column) vis-à-vis the atmospheric pressure, whereby the gas pressure required in the oven chambers is controlled by the shutoff and throttling devices mounted in the hot stream of gas on the raw gas outlet of the oven chambers. It is within the scope of the invention as well that the hot gas collector is operated at a pressure that is elevated versus the atmospheric pressure. The shutoff and throttling devices have to be capable of withstanding the high gas temperatures between 600° and 1000° C., and comprise throttling elements made of a high-temperature resistant ceramic and/or metallic material. The cross section of the opening of the shutoff and throttling devices is controlled via the operating pressure in the oven chambers. A pressure pulse is tapped on the oven chambers and compared to a nominal value. The setting movements of the shutoff and throttling devices are controlled depending on the deviations occurring between the nominal value and the actual value. It is within the scope of the invention as well that individual oven chambers are separated from the hot gas collector under certain operating conditions by closing the respective oven chambers, in particular in order to prevent gas mixtures containing air oxygen from entering the hot gas collector.

Since the raw gas is made available for further utilization without lowering the raw gas temperature, not only the chemical energy bound in the raw gas is exploited, but the physical heat as well. The physical heat discharged from the oven chambers together with the raw gases corresponds with about 20% of the coking heat, or with about 500 kJ per kg coal processed, which, according to the method as defined by the invention, can be additionally exploited. Owing to the method as defined by the invention, gas treatment and waste water treatment plants are dispensed with, and a coke oven battery consequently can be operated in such a way that only two products are produced, notably coke, on the one hand, and electrical power or synthesis/reduction gas on the other. The method as defined by the invention is suited for application in connection with horizontal chamber ovens, whereby the advantages known from said technique such as a high coke yield, a uniform quality of the coke, and high output density remain preserved to the fullest extent.

Furthermore, the object of the invention is a coke oven battery as well for carrying out the method described above. The coke oven battery comprises

- a plurality of oven chambers having a raw gas outlet located in the ceiling of the oven;
- a hot gas collector for evacuating hot raw gases developing during coking in the oven chambers; and
- devices for conveying the raw gas that connect the raw gas outlets with the hot gas collector.

whereby the devices for conveying the raw gas each comprise a shutoff and throttling device with an associated servo-drive for setting the device, and whereby the servo-drives can be controlled depending on the pressure measured in the oven chambers, and a pressure independent of the operation of the hot gas collector can be adjusted in this way in the oven chambers. The shutoff and throttling devices have a throttling body made of high temperature-resistant ceramic and/or metallic material, and each are arranged in a valve housing. The short inlet pipe of said valve housing is connected with the raw gas outlet of the oven chamber, and its short outlet pipe is connected with the hot gas collector.

Different engineering possibilities are available for designing the construction of the shutoff and throttling device. According to a first embodiment, the shutoff and throttling device is realized in the form of a rotating slide. The axis of rotation of said rotating slide is aligned with the short inlet pipe of the valve housing, and its underside is provided with a wedge-like shape. When in a closing position, the rotating slide blocks the opening of the short outlet pipe. By means of a setting movement of the revolving slide, a flow path defined by the wedge-shaped area is released between the short inlet pipe and the outlet pipe. An upper bearing plate is usefully connected with the throttling body of the revolving slide, such a bearing plate resting on a ring-shaped support surface of the valve housing and being guided on said support surface.

According to a second embodiment of the invention, the shutoff and throttling device has an axially adjustable, piston-shaped throttling body, of which the adjusting axis is aligned with the short outlet pipe of the valve housing. The face side of the throttling body is designed in the form of a wedge-shaped, conical seating surface, which is movable against an annular surface of the valve housing located on the outlet side. The piston-shaped throttling body of the valve housing is guided in a cylindrical housing segment of the valve housing in a linear way, as well as rotating about the setting axis. The throttling body is adjusted by a suitable servo-drive such as, for example a spindle driven by an electric motor.

According to a third embodiment of the invention, provision is made that the shutoff and throttling device has a wedge-shaped throttling body of which the setting axis is aligned with the short inlet pipe of the valve housing. The throttling body is driven vertically by a suitable setting mechanism, and for rotation about the vertical axis.

In conjunction with all constructions of the shutoff and throttling device, the valve housing is usefully provided with a lateral opening for inspections that is sealed by a cover.

Figure 1A:
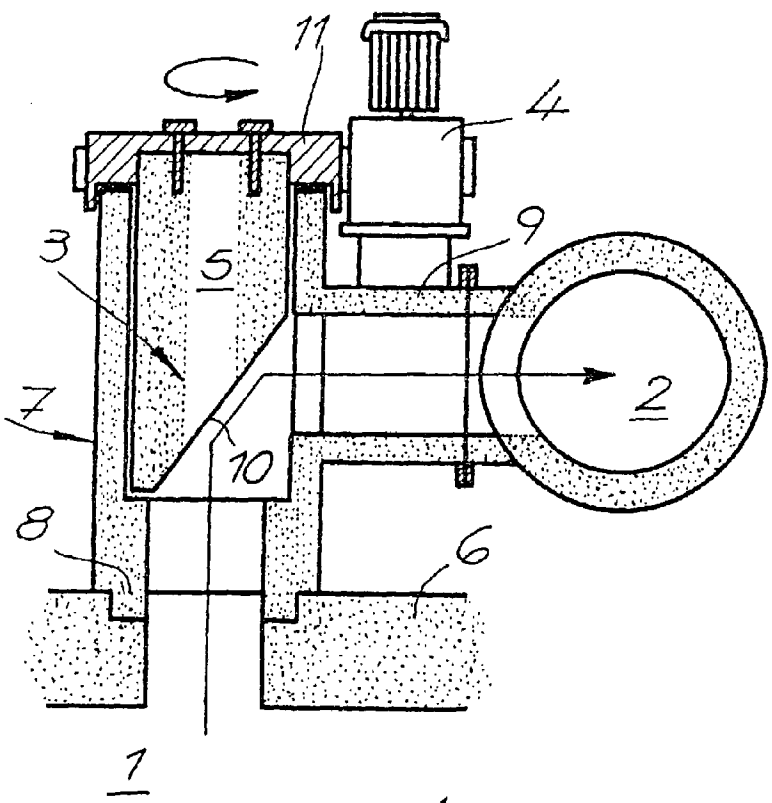
Figure 2:
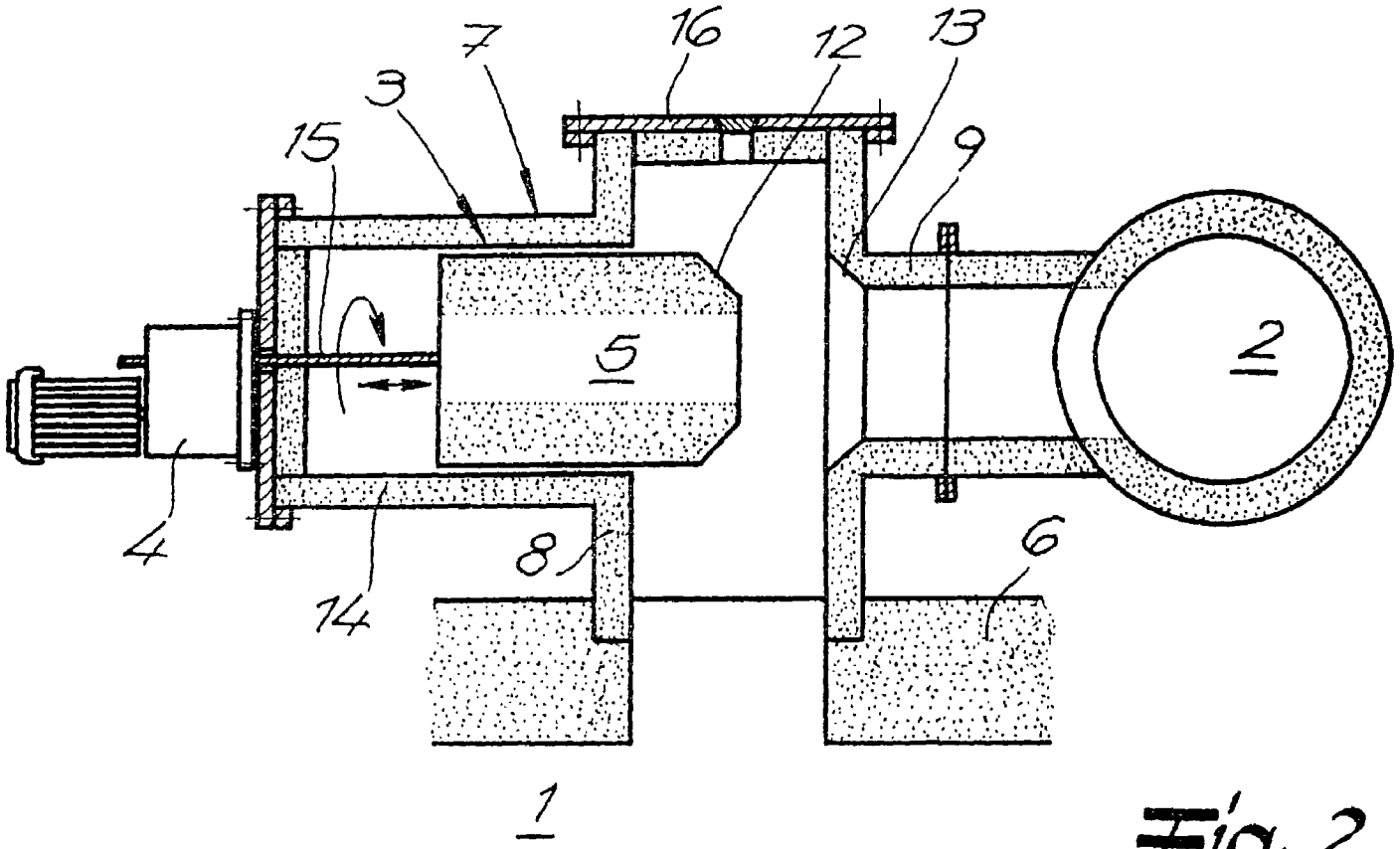
Figure 3:
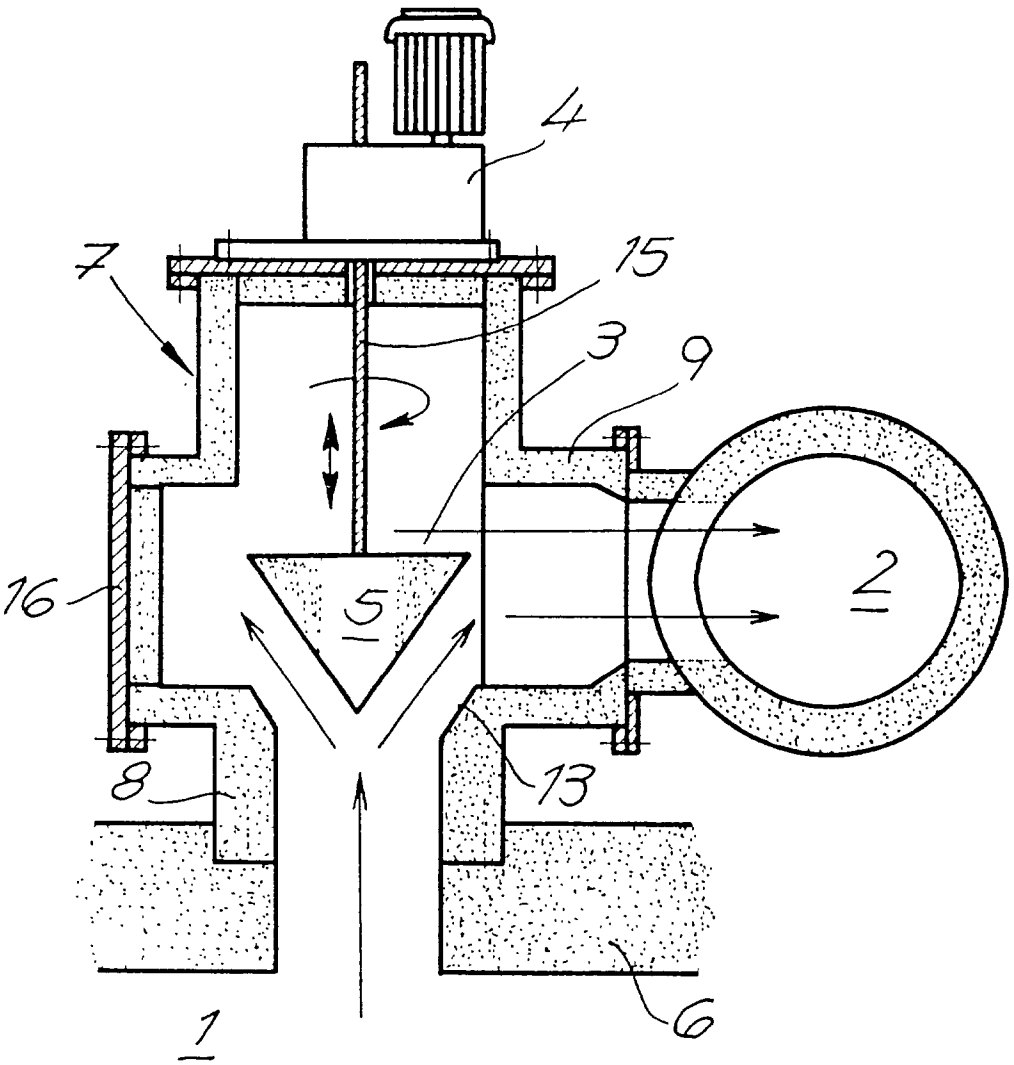

The invention is explained in the following with the help of a drawing showing only one single exemplified embodiment of the invention. The following is schematically shown in the drawing, where FIGS. 1*a* and 1*b* show the different operating positions of a device for controlling the raw gas, which connects a raw gas outlet located on the oven ceiling of the coke oven battery; and with a hot gas collector; and FIGS. 2 and 3 show other embodiments of the device as defined by the invention.

The devices shown in the figures serve for evacuating hot raw gases developing in the coking process in the oven chambers 1 of a coke oven battery. The raw gases exiting from the oven chambers 1 at a temperature of about 800° C. are admitted into a hot gas collector 2, which is operated by a suction method with a vacuum of 20 to 50 mm WS (water column) versus the atmospheric pressure. From the hot gas collector 2, the gas is supplied to a steam boiler firing system and completely combusted there, or converted into a synthesis or reduction gas in a fission reactor. The gas pressure required for the coking process in the oven chambers 1 is safely maintained by the devices shown in the figures irrespectively of the pressure level prevailing in the hot gas collector 2.

The devices shown in the figures for controlling the raw gas have a basic structure comprising in each case a shutoff and throttling device 3 with an associated servo-drive 4. The servo-drive 4 is controllable depending on the pressure measured in the oven chamber 1, so that it is possible to adjust a pressure in the oven chambers 1 that is not depending on any pressure level in the hot gas collector 2. It is possible with the devices to separate individual oven chambers from the hot gas collector as well.

The shutoff and throttling devices each have a throttling body 5 made of a thermally highly stable ceramic and/or metallic material, and each are arranged in a valve housing 7 mounted on the ceiling 6 of the oven. The short inlet pipe 8 of the valve housing is connected with the gas outlet located in the oven ceiling 6, and its short outlet pipe 9, which is set at a right angle, is connected with the hot gas collector 2. In the embodiment shown in FIGS. 1*a* and 1*b*, the shutoff and throttling device 3 is realized in the form of a rotating slide, of which the axis of rotation is aligned with the short inlet pipe 8 of the valve housing 7, and of which the underside 10 has the shape of a wedge. When it is in the closing position shown in FIG. 1*b*, the rotating slide blocks the opening of the short outlet pipe 9. By means of the setting movement of the rotating slide, it is possible to release a flow path defined by the wedge-shaped area between the short inlet pipe 8 and the short outlet pipe 9 (FIG. 1*a*). The cross section of the flow path is dependent upon the angle of rotation of the rotating slide. For supporting the rotating slide, a bearing plate 11 is connected with the upper side of the throttling body 5. Said bearing plate rests on a ring-shaped support surface of the valve housing 7 and is guided on said support surface. The servo-drive 4 comprises a stepping motor that is controlled by a control device not shown.

In the embodiment shown in FIG. 2, the shutoff and throttling device 3 has an axially adjustable throttling body 5 revolving around the setting axes. The setting axis of said throttling body is aligned with the short outlet pipe 9 of the valve housing 7. The face side of the throttling body is provided with a cone-shaped seating surface 12, which is movable against a conical ring surface 13 of the valve housing 7 located on the outlet side. The piston-shaped throttling body 5 is guided in a cylindrical housing segment 14 of the valve body. A spindle 15 acting as the setting means is connected with the throttling body. Said spindle penetrates the setting drive 4 with its end located on the driving side.

In the embodiment shown in FIG. 3, the shutoff and throttling device 3 has an axially adjustable, cone-shaped throttling body 5, the setting axis of which is aligned with the short inlet pipe 8 of the valve housing 7. The throttling body is movable with a linear setting movement and an additional rotational motion against a conical ring surface 13 of the valve housing 7 located on the inlet side, and is secured suspended on a spindle 15, whose end located on the driving side penetrates the servo-drive 4.

The valve housing of the devices shown in FIGS. 2 and 3 is provided with a lateral opening for inspections, which is sealed by a cover 16.

The invention claimed is:

1. A method for evacuating hot raw gases developing in a coking process in the oven chambers of a coke oven battery, wherein (a) the raw gases are evacuated from the oven chamber at a temperature of from 600° to 1000° C. and admitted into a hot gas collector without lowering the raw gas temperature;

(b) the pressure in the oven chambers is measured and controlled by shut-off and throttling devices irrespectively of the level of the pressure in the hot gas collector, said devices being arranged in the hot gas streams between the raw gas outlet of the oven chambers and the hot gas collector, and their position being controlled depending on the pressure measured in the associated oven chamber;

(c) the gas from the hot gas collector is supplied to a steam boiler firing system or a fission reactor; and (d) the hot gas collector is operated at a pressure that is reduced versus the atmospheric pressure.

2. A coke oven battery for carrying out the method according to claim 1, comprising a plurality of oven chambers (1) having a raw gas outlet located in the oven ceiling (6);

a hot gas collector (2) for evacuating hot raw gases developing during a coking process in the oven chambers (1); and devices for controlling the raw gas connecting the raw gas outlets with the hot gas collector (2);

characterized in that the devices for controlling the raw gas each comprise a shut-off and throttling device with an associated servo-drive (4); that the servo-drives (4) are controllable depending on the pressure measured in the oven chamber (1); that a pressure independent of the operation of the hot gas collector (2) is adjustable in this way in the oven chambers (1), and whereby the shut-off and throttling devices (3) have a throttling body (5) made of a thermally highly stable ceramic and/or metallic material; that the shut-off and throttling device (3) is designed as a rotating slide whose axis of rotation is aligned with a short inlet pipe (8) of the valve housing (7), and whose underside (10) has the shape of a wedge; that the rotating slide blocks the opening of a short outlet pipe (9) when it is in a closing position; and that a flow path defined by the wedge-shaped area (10) between the short inlet pipe (8) and the short outlet pipe (9) is releasable by a setting movement of the rotating slide.

3. The coke oven battery according to claim 2, wherein a top-side bearing plate (11) is connected with the throttling body (5) of the rotating slide, said bearing plate resting on a ring-shaped seating surface of the valve housing (7).

4. The coke oven battery according to claim 2, wherein the shut-off and throttling device (3) has an axially adjustable, piston-shaped throttling body (5) whose setting axis is aligned with a short outlet pipe (9) of the valve housing (7); and that the face side of the throttling body (5) is realized in the form of a cone-shaped seating surface (12), the latter being movable against a conical annular surface (13) of the valve housing (7) located on the outlet side.

5. The coke oven battery according to claim 4, characterized in that the piston-shaped throttling body (5) is guided with linear mobility in a cylindrical housing segment (14) of the valve housing and rotating about the setting axis.

6. A method for evacuating hot raw gases developing in a coking process in the oven chambers of a coke oven battery, wherein (a) the raw gases are evacuated from the oven chamber at a temperature of from 600° to 1000° C. and admitted into a hot gas collector without lowering the raw gas temperature;

(b) the pressure in the oven chambers is measured and controlled by shut-off and throttling devices irrespectively of the level of the pressure in the hot gas collector, said devices being arranged in the hot gas streams between the raw gas outlet of the oven chambers and the hot gas collector, and their position being controlled depending on the pressure measured in the associated oven chamber;

(c) the gas from the hot gas collector is supplied to a steam boiler firing system or a fission reactor; and (d) the hot gas collector is operated at a pressure which is elevated versus the atmospheric pressure.

7. A coke oven battery for carrying out the method according to claim 1, comprising (a) a plurality of oven chambers (1) having a raw gas outlet located in the oven ceiling (6);

(b) a hot gas collector (2) for evacuating hot raw gases developing during a coking process in the oven chambers (l); and (c) devices for controlling the raw gas connecting the raw gas outlets with the hot gas collector (2);

wherein the devices for controlling the raw gas each comprise a shut-off and throttling device with an associated servo-drive (4); the servo-drives (4) are controllable depending on the pressure measured in the oven chamber (1); a pressure independent of the operation of the hot gas collector (2) is adjustable in this way in the oven chambers (1), and whereby the shut-off and throttling devices (3) have a throttling body (5) made of a thermally highly stable ceramic and/or metallic material; the shut-off and throttling device (3) has a cone-shaped throttling body (5), whose setting axis is aligned with the short inlet pipe (8) of the valve housing (7); and the throttling body (5) is movable with a linear movement, as well as with a rotational movement around the setting axis against a conical, ring-shaped surface (13) of the valve housing (7) located on the inlet side.

* * * * *

UNITED STATES PATENT AND TRADEMARK OFFICE

CERTIFICATE OF CORRECTION

PATENT NO. : 7,122,099 B2
APPLICATION NO. : 10/111290
DATED : October 17, 2006
INVENTOR(S) : R. Schumacher et al.

It is certified that error appears in the above-identified patent and that said Letters Patent is hereby corrected as shown below:

In Column 5, line 23, (Line 5 of Claim 4), after the word "and" please delete: "that".

Signed and Sealed this

Twenty-sixth Day of December, 2006

JON W. DUDAS
*Director of the United States Patent and Trademark Office*